United States Patent [19]

Svantesson

[11] Patent Number: 4,589,335

[45] Date of Patent: May 20, 1986

[54] STENCIL PRINTING MACHINE

[76] Inventor: Ake Svantesson, Apertado 36, Fuengirola, Malaga, Spain

[21] Appl. No.: 551,412

[22] Filed: Nov. 14, 1983

Related U.S. Application Data

[62] Division of Ser. No. 458,170, Jan. 14, 1983, abandoned.

[30] Foreign Application Priority Data

Jan. 19, 1982 [SE] Sweden ..... 8200276

[51] Int. Cl.[4] ..... B41F 15/08; B41F 15/10

[52] U.S. Cl. ..... 101/114; 101/115; 101/126

[58] Field of Search ..... 101/114, 115, 118, 123, 101/124, 126, 271, 286, 287, 288, 316

[56] References Cited

U.S. PATENT DOCUMENTS

| | | | |
|---|---|---|---|
| 836,483 | 11/1906 | Burdick | 101/123 |
| 2,609,747 | 9/1952 | Schwartz et al. | 101/115 |
| 2,690,118 | 9/1954 | Schwartz et al. | 101/123 X |
| 3,180,253 | 4/1965 | Hildmann | 101/316 X |
| 3,215,071 | 11/1965 | Stillwell | 101/126 |
| 3,460,470 | 8/1969 | Green et al. | 101/115 |
| 3,577,914 | 5/1971 | Ronge | 101/124 |
| 3,812,779 | 5/1974 | Cobb | 101/193 X |
| 4,003,476 | 1/1977 | Laskey | 101/114 X |
| 4,058,307 | 11/1977 | Bubley et al. | 101/123 X |
| 4,094,242 | 6/1978 | Ichinose | 101/123 |

FOREIGN PATENT DOCUMENTS

| | | | |
|---|---|---|---|
| 93552 | 7/1981 | Japan | 101/126 |
| 631363 | 11/1978 | U.S.S.R. | 101/114 |

*Primary Examiner*—Edgar S. Burr
*Assistant Examiner*—Moshe I. Cohen
*Attorney, Agent, or Firm*—Burns, Doane, Swecker & Mathis

[57] ABSTRACT

Stencil printing machine including one or more printing tables, a number of movably arranged material gripping and displacement arrangements, a stencil tensioned in a frame located above each printing table and doctor blade arrangement which can interact with the stencil. At least one material gripping and displacement arrangement has imparted to it a reciprocating motion between two predetermined positions. One position for gripping and fetching material intended for printing and a second position for placing the fetched material on the printing table. The position of the arrangement is registered in both the first and the second position.

6 Claims, 6 Drawing Figures

STENCIL PRINTING MACHINE

CROSS-REFERENCE TO RELATED APPLICATION

This is a division of my copending U.S. Ser. No. 458,170, filed Jan. 14, 1983 now abandoned in favor of FWC Ser. No. 654,524 filed Sept. 25, 1984.

TECHNICAL FIELD

The present invention relates to a stencil printing machine which includes at least two printing tables; a plurality of reciprocably movable material gripping and displacement arrangements; at least two stencil frames for tensioning a stencil above each printing table; and doctor blade arrangements, which in use interacts with the stencil; at least two of the material gripping and displacement arrangements being joined to each other to form an assembly of arrangements for enabling a common reciprocating motion to be imparted to the arrangements.

BACKGROUND

Stencil printing machines are known which provide an adjustment arrangement for material gripping and displacement arrangements, usually designated as gripper beams. This adjustment arrangement is intended to impart a precise position to the gripper beams in relation to a printing table in the printing machine. The gripper beams include members for gripping and displacing a material. For their movement the gripper beams interact with at least one, preferably two, endless feed chains or the like, which are arranged in parallel. These cease to move when the gripper beams are located in predetermined positions, one for the gripper beam to grip a sheet or material intended for printing, and one for the gripper beam to hold or leave a sheet in a position for application of print to the sheet. The gripper beams can be made adjustable by means of a double lever arm system so that the gripper beams adopt precisely the said predetermined positions, by providing the end surfaces of the gripper beams and the outer ends of a double lever arm system with interacting members.

Here the members comprise on the one hand convex, preferably cylindrically or spherical surfaces and secondly preferably "V"-shaped recesses which are intended to be pressed against each other in the predetermined position.

An adjustment arrangement of the type mentioned above has been described previously in British Patent Specification No. 1 208 614.

Further it is previously known from U.S. Pat. No. 4,031,824 to use a single elongated feed gripper member and a single elongated delivery gripper member, which are mounted in spaced relationship on a transfer carriage assembly movable relative to the printing bed of a printing press on a frame having a pair of parallel spaced rails. The feed gripper member and delivery gripper member are maintained in spaced, parallel relationship near opposite ends of the transfer carriage and move with the transfer carriage as a single unit relative to the printing bed.

In operation, the stock to be printed may be first registered to the outside of the printing bed of the press and the feed gripper member, being mounted on a spring-biased cam-operated mounting plate moved horizontally and vertically relative to the stock to be printed to pick it up by vacuum in a registered position.

The transfer carriage then moves along the rails of the frame so that the stock is brought into a printing position by the feed gripper. As the feed gripper is moving toward the printing bed, the delivery gripper, consisting of a pair of elongated, parallel jaws which open in opposite directions about a common pivot pin, has simultaneously engaged and gripped a protruding edge of a sheet of printed stock and begun to transfer such stock to a delivery position.

After feeding and delivery has been accomplished, the transfer carriage may be quickly returned to its initial position and begin to repeat the process. The operation of the printing press is preferably timed so that printing is accomplished during return of the transfer carriage.

It is already known that the drive for the gripper beams described above with endless drive chains arranged in parallel becomes extremely complicated, because it is not only a question of driving the chains intermittently so that the gripper beams stop in predetermined positions, but furthermore tensioning arrangements are required for the chains and also other mechanical members. Furthermore it is known that a drive arrangement for gripper beams of the type mentioned above has to be dimensioned for high power input, because the construction as a whole becomes heavy and the acceleration and retardation moments require high power inputs.

There has long been a desire to be able to create conditions such that the drive arrangement for the gripper beams is made simpler, while at the same time the gripper beam design is made light and simple, thereby making it possible to displace the gripper beams rapidly between two predetermined positions without excessive consumption of power.

Furthermore it is a difficult technical problem to create conditions such that the transport speed of the gripper beams is easily capable of regulation, for example, so that the gripper beam is subjected to high acceleration, high velocity and a somewhat reduced retardation.

Furthermore there has been a desire, and this represents a difficult technical problem, to create conditions such that, in connection with stencil printing machines, the material provided with a printed image can be delivered easily. It is particularly advantageous if special delivery belts and special delivery fingers can be eliminated.

A particular problem which has been encountered with stencil printing machines, especially with such stencil printing machines that function at high printing speeds, is that the insertion time for material intended to be printed to reach the insertion position is short and this becomes particularly difficult when insertion is carried out manually.

OBJECTS AND SUMMARY OF THE INVENTION

Consequently, it is an object of the invention to construct stencil printing machines that function with short printing times while creating the longest possible insertion times. This would be particularly advantageous if the entire, or almost the entire printing time, could be utilized as insertion time.

It is also an object of the invention to create conditions such that the material intended for printing can either be taken automatically from an inserter or direct from a feed stack so as to be gripped by a gripper beam, or else the material can be inserted by hand and registered in an insertion position.

It is a further object of the invention to create conditions such that the transport speed of the gripper beams can be regulated in a simple manner, and particularly to be infinitely-variably regulated, and it is particularly advisable to provide a very rapid reciprocating movement of the gripper beams.

Another object of the invention is to construct a stencil printing machine from a few simple parts and still achieve accurate printing at a high speed.

A further object of the invention is to construct a stencil printing machine in such a way that a gripper arrangement can move reciprocably over the printing table and place a material onto the table in a registered position during printing.

A further object of the invention is to construct a stencil printing machine with reciprocably arranged gripper arrangements in such a way that one and the same machine can be used for multi-color processes.

A further object of the invention is to construct the gripper arrangement in such a way that the print pattern can be arranged very close to the gripper arrangement, when said arrangement is holding the material during the printing sequence.

These and other objects of the invention are accomplished by a construction of a stencil printing machine of the type mentioned above and which includes at least two printing tables; a plurality of reciprocably movable material gripping and displacement arrangements; at least two stencil frames for tensioning a stencil above each printing table; and a doctor blade arrangement, which in use interacts with the stencil; at least two of the material gripping and displacement arrangements being joined to each other to form an assembly of arrangements for enabling a common reciprocating motion to be imparted to the arrangements.

The invention is characterized in that said assembly includes three or more said material gripping and displacement arrangements joined to each other during their reciprocating movements so that in operation and in a first position of the assembly the said first arrangement grips a said first item of material, which is to be printed, at its insertion position, while the remaining arrangements each grip a respective further item of printed material at a respective printing position thereof; and in a second position of the assembly, each of the arrangements, apart from the last, has brought a respective said item of material to a printing position, while the said last arrangement has brought an item of material provided with at least two prints to a delivery position.

The invention is also characterized by the fact that the arrangements can be displaceably installed along two parallel-oriented guides, one arrangement being registered during the gripping of the material intended for printing in the insertion position, while the second arrangement can be registered when placing the material into the printing position.

By arranging the insertion position above the printing position, while at the same time displaceably mounting the arrangements along two parallel guides, a simple construction is achieved.

By means of this arrangement it is possible to undertake multi-color printing and different printing positions on the same material. It is furthermore proposed that the pivoting movement of the guides up and down takes place via a cam disc which is driven by the stencil machine drive machinery. The invention also relates to an alternative, where the printing table will be displaceably arranged so that it can move upwardly and downwardly, in its upper position being capable of providing support for the material in the printing position. Finally, as an alternative, the material gripping and displacement arrangement can be raised and lowered.

The main advantages which can be perceived as being linked with a stencil printing machine intended for multi-color printing in accordance with the present invention are that the design of the gripper beams and its drive machinery can be made much simpler than with previously known machines, while at the same time the machine is made of light construction; thus permitting rapid movement of gripper beams between different predetermined positions and this rapid movement can take place without the consumption of large quantities of power and energy.

BRIEF DESCRIPTION OF DRAWINGS

A more detailed description will be given by reference to the appended drawings of a number of proposed embodiments which exhibit the characteristic features of the present invention, where.

DESCRIPTION OF PROPOSED EMBODIMENTS

Figure 1:
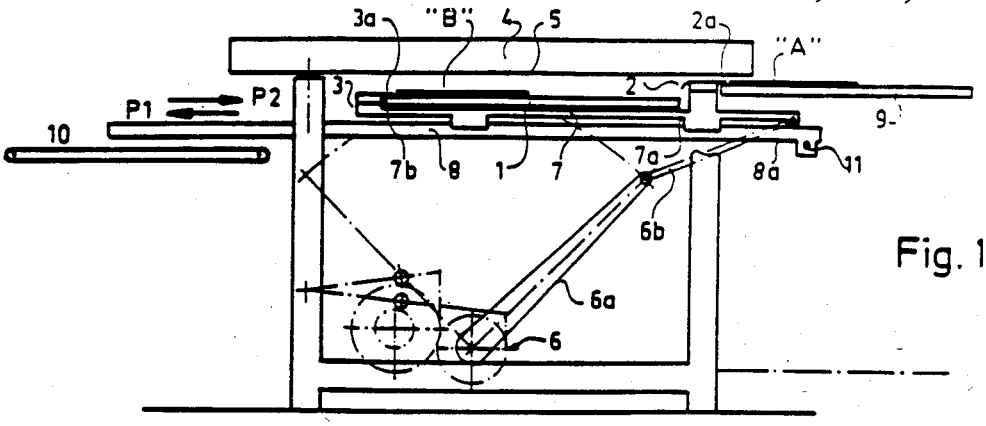
FIG. 1 shows in side view and in greatly simplified fashion the principle of a stencil printing machine operating in accordance with the theory of the invention and with a guide which is capable of swivelling at one end occupying its upper position.

With reference to FIG. 1, this shows in a side view and in a greatly simplified form a stencil printing machine in accordance with the present invention.

The stencil printing machine includes a printing table 1, two movably arranged material gripping and displacement arrangements which include gripper beams 2 and 3, a blanket 5 which is tensioned in a frame 4 upon which a stencil is applied. The blanket 5 is located directly above the printing table 1. A conventional doctor blade and ink filling arrangement, not shown, interact with the stencil 5.

FIG. 1 illustrates a drive mechanism 6 which is intended via an arm **6*a* and a connecting arm 6*b* to displace the gripper beams 2 and 3** in a reciprocating movement.

A beam 7 is fastened at one end **7*a* to the gripper beam 2. The other end 7*b* is attached to the gripper beam 3 so that the gripper beams 2 and 3 can be displaced along a guide 8, to and fro, as indicated by the arrows P1 and P2** by means including drive mechanisms 6, 6*a* and 6*b*. Conventional means, shown in broken lines adjacent mechanism 6, control and impart the required movements to the gripper beam 2 between two stop positions.

In an initial position shown in FIG. 1, the gripping member 2*a* of one gripper beam 2 is designed to grip an initial item of material "A" which is located in an insertion position, in the embodiment resting on a table 9.

Figure 2:
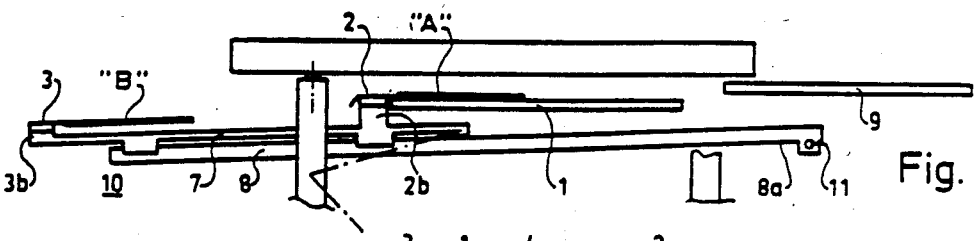
FIG. 2 shows a machine in accordance with FIG. 1 with the guide in a lower position.

The second gripper beam 3 is intended, using its gripper member 3*a*, to grip another item of material "B" located in a printing position to be provided with a printed image in the printing position by a doctor blade arrangement being displaced along the stencil 5 and pressing printing ink which is present on the upper face of the stencil through the blanket 5 so as to form a coating or a printed image on the material "B". When the gripper beams 2 and 3 have each gripped their material "A" and "B" the gripper beams 2 and 3 are displaced to a second position. In this position as shown in FIG. 2 one of the gripper beams 2 is designed to leave the first item of material "A" intended for printing in the printing position for printing table 1, while the second gripper beam 3 is designed to hand over the printed material "B" to a delivery position. This delivery position has been given the reference notation number 10.

In the diagrams reference is made solely to one guide 8 and one beam 7 but obviously two parallel-oriented guides 8 and between them two parallel-oriented beams 7 may be provided to ensure stability as regards the displacement of the gripper beams 2 and 3.

To ensure that the gripper beams 2 and 3 adopt a precise position in relation to the frame of the stencil printing machine it is obvious that the gripper beam 2 should be registered, in a manner known in the art when gripping the material "A" in the insertion position 9 as shown in FIG. 1, and the gripper beam 2 must be registered when leaving the material "A" in the printing position 1 as shown in FIG. 2.

Pivoting of the guides around the pivot 11, upwardly and downwardly, takes place via a cam disc which is driven by the printing machine drive machinery, schematically shown on the broken line mechanism adjacent drive means 6.

The operation of the reciprocal and registering movements of the gripper beams is as follows: when moving to the second position, guide rail 8 is maintained in a horizontal position until gripper beam 2 and material "A" is above the delivery position and gripper beam 3 and material "B" is above the printing position. At this time, suitable means such as a conventional camming mechanism permits guide 8 to pivot downwardly, bringing gripper beam 3 and material "B" onto the delivery station and gripper beam 2 and material "A" onto the printing table 1. Gripping elements 2*a* and 3*a* of gripper beams 2 and 3, respectively, are released by means well-known in the art. Guide 8, along with gripper beams 2 and 3, is pivoted back to a horizontal position and moved in a horizontal position to the first position wherein material "A", in the printing position, is gripped by the gripping element of gripper beam 3 and a new material that has been deposited at station 9 is gripped by the gripping element of gripper beam 2.

The gripper beams 2 and 3 are shown joined to each other via the beam 7. It can be advisable to make the supports to 2*b* and 3*b* somewhat resilient, by this means committing the adjustment and registration of the gripper beam in its position.

The example forming the above embodiment illustrates that the insertion position 9 is orientated some distance above the printing position 1 and that the gripper beams are displaceably arranged along two parallel guides 8. However, at one end surface 8*a* these guides 8 can pivot to some extent about pivot 11 which means that it should be possible to impart to the gripper beam 2 a horizontal or at least essentially horizontal movement from the insertion position 9 to the printing position, whereby the gripper beam drops downwardly to the printing position so that the material can be made to rest against the printing table 1.

In an alternate embodiment of the invention three or more material gripping and displacement arrangements or gripper beams 2, 3 are joined to each other during their reciprocating movement, thus allowing several prints to be made simultaneously. In such a case the delivery position 10 is modified to be a printing table. The printing table 1 is used to apply an initial color to the material "B" while the printing table at 10 applies a second color to the same material. In the first position illustrated in FIG. 1, one of the gripper beams 2 is intended to grip an initial material "A" in its insertion position 9 while the remaining gripper beams are intended each to grip other material in their respective printing positions. The gripper beam 3 grips the material "B" at the printing table 1, while the next gripper beam (not shown) grips the material which has been printed at a printing table located at 10.

In the second position one of the gripper beams 2 and the remainder, apart from the last, are each intended to leave their respective materials in their printing position. The last gripper beam is intended to hand over a printed material to a delivery position.

Figure 3:
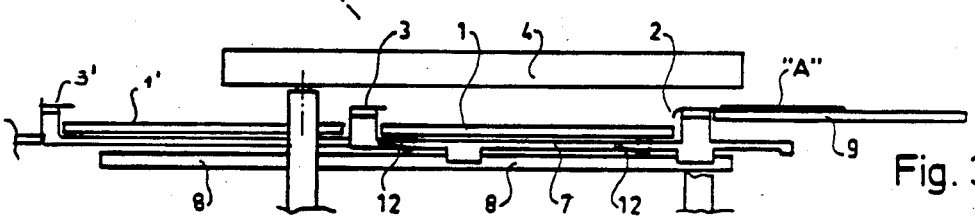
FIG. 3 shows in side view and in greatly simplified fashion the principle of a stencil printing machine operating in accordance with the theory of the invention and with a printing table which is capable of being raised and lowered occupying its lower position.
Figure 4:
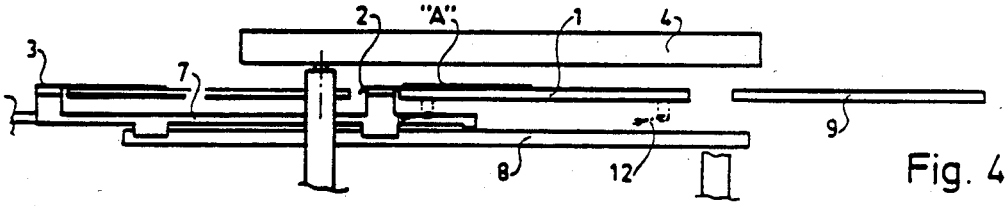
FIG. 4 shows the machine in accordance with FIG. 3 where the printing table is in its upper position.

With reference to FIGS. 3 and 4, an embodiment is shown where the printing table 1 can be raised and lowered.

The printing table 1, is shown best in FIG. 4 and is supported by a parallel link system 12 and by this means the printing table can adopt a lower position as shown in FIG. 3 and an upper position as in FIG. 4.

During the period when the gripper beam 2 displaces the material "A" intended for printing from the insertion position 9 to the printing position on printing table 1, the printing table is located in a lower position and permits the gripper beam 2 to pass across the printing table 1 along fixed guides 8.

However when gripper beam 2 adopts the position shown in FIG. 4 and the material "A" is located above the printing table 1, the printing table 1 is raised to the position illustrated in FIG. 4 and print can be applied to the material "A".

The printing table 1 is lowered and the gripper beam 2 reverts to the position shown in FIG. 3 in order to fetch new material while at the same time gripper beam 3, after raising of the printing table, can grip the printed material.

During further displacement of the gripper beams 2 and 3 to the left, the gripper beam 3 removes the printed material from the printing table while gripper beam 2 locates a new item of material intended to be printed on printing table 1.

Figure 5:
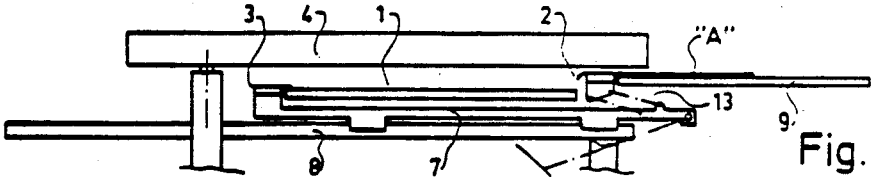
FIG. 5 shows in side view and in greatly simplified fashion the principle of a stencil printing machine operating in accordance with the theory of the invention with a gripper beam capable of being raised and lowered occupying its upper position.
Figure 6:
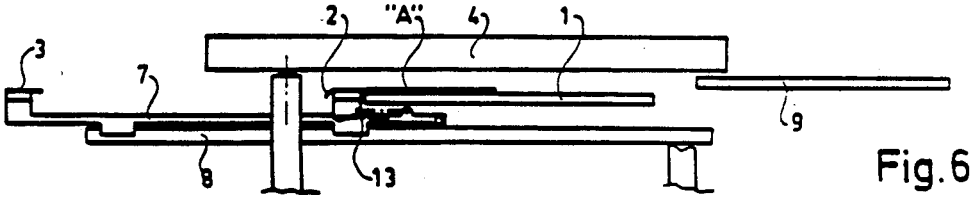
FIG. 6 shows the machine in accordance with FIG. 5 with the gripper beam in its lower position.

FIGS. 5 and 6 illustrate an embodiment where the gripper beams, particularly gripper beam 2, can be raised and lowered.

Here there is a fixed delivery table 9 and a fixed printing table 1 together with fixed orientation of the guides 8.

The gripper beam 2 is attached to beam 7 via a system of parallel rods 13 so that as illustrated in FIG. 5 gripper beam 2 can adopt an upper position so as to grip a material "A" intended for printing. Gripper beam 2 adopts this upper position during its displacement along the fixed guides 8 to the printing position above printing table 1, after which gripper beam 2 is dropped down to its lower position as shown in FIG. 6 and here places the material "A" intended for printing in the printing position on the fixed printing table 1.

Otherwise the sequence is the same as for the embodiments previously described.

Even though the specification includes three embodiments which have been described separately, it should be borne in mind that a combination of two or several embodiments can also satisfy the inventive concept.

As previously mentioned the principle underlying the invention can also be utilized for one gripper beam 2. After registration, this grips in the insertion position 9 and transports the material "A" to printing table 1. Here the gripper beam 2 is registered once again and the material is fastened to the printing table. Then the gripper beam can revert to the insertion position 9.

Now, during the entire printing stage, it is possible to adjust the material intended for printing to the registration mark in the insertion position.

Naturally the invention is not restricted to the embodiments cited above by way of example but can also be subjected to modifications within the framework of the following patent claims.

It is to be expected that the embodiment shown in FIGS. 3 and 4 is especially preferred. This embodiment has an upper frame 4, in which the stencil is arranged and supported in a well known manner together with an ink filler and a doctor blade (not shown), which may reciprocate along the stencil and in only one direction of movement press the ink through apertures in the stencil, said apertures forming the pattern to be printed onto the material "A".

Said frame 4, together with the ink filler and the doctor blade and the stencil is movably arranged up and down and so controlled in said movement that in the upper position the material "A" is transported of the gripper 2 along the printing table 1 (from the position shown in FIG. 3 to the position shown in FIG. 4). During this transportation the printing table is in its lower position.

Then the frame 4 is moved to its lower position and the printing table is moved to its upper position and in these positions the printing sequence may start.

Due to the fact that the gripper 2 has an upper smooth surface (plane surface) lying more or less in the same plane as the material "A", when rested upon the printing table, it is possible to print the material "A" when said material is gripped by the gripper 2, and further to start the printing and its printing pattern adjacent the edge of the material and adjacent the gripper 2. The gripper 2 serves as registering device of the material on the table 1.

In particular, it has been found that in operation in a first position of the assembly, a first said arrangement grips a first item of material, which is to be printed, at an insertion position and a second said arrangement grips a second item of material, which has been printed at a printing position and in a second position of the assembly, the first said arrangement has brought the first item of material to be printed to the printing position and the second said arrangement has brought the second item at material, which has been printed to a further printing position.

I claim:

1. A stencil printing machine wherein material to be printed follows a path from an insertion position to plural printing positions including: an insertion table; at least two printing tables; one of the printing tables disposed along said path to receive an item of material from said insertion table; said one of the printing tables disposed at a lower height than said insertion table; each successive remaining printing table being at a lower height than a preceding table; at least three reciprocably movable material gripping and displacement arrangements connected to each other; at least two stencil frames for tensioning a stencil above a printing table; a beam member; at least two of the said material gripping and displacement arrangements connected to said beam member to form an assembly of arrangements; means to impart a common reciprocating motion to the arrangements such that in operation in a first position of the assembly a first one of the arrangements grips a first item of material to be printed at said insertion position and the remaining arrangements each grip and hold a respective additional item of material at different respective printing positions; and in a second position of the assembly the first said arrangement holds said first item of material at a first printing position on said one of the printing tables and at least one of said at least three arrangements has simultaneously moved a respective said item of material from said first to a second printing position, a remaining one of said at least three arrangements simultaneously delivering an item of material provided with at least two prints to a delivery position at a lower height than a preceding printing table; said means to impart a common reciprocating motion including a drive mechanism drivingly connected to a drive arm means for providing said reciprocating motion; said at least two material gripping and displacement arrangements being integral with said beam member; said beam member being drivingly connected to said drive arm means, a guide member; said arrangements and said beam member being reciprocatingly displaceable along said guide member, said guide member provided with a free end and a fixed end so as to permit pivotal movement upwards and downwards of the free end about the fixed end so that each item of material is moved sequentially downward from the insertion table to each printing table and then to the delivery position.

2. A stencil printing machine wherein material to be printed follows a path from an insertion position to a printing position and to a delivery position; an insertion table; a printing table spaced from said insertion table along said path and at a lower height then said insertion table; a delivery table spaced along said path from said printing table and disposed at a lower height than said printing table; a plurality of reciprocably movable material gripping and displacement arrangements; a stencil frame for tensioning a stencil above said printing table; a beam member; at least two of said material gripping and displacement arrangements connected to said beam member to form an assembly of arrangements, means to impart a common reciprocating motion to the arrangements such that in operation in a first position of the assembly, a first said arrangement grips a first item of material to be printed at said insertion table, and a second said arrangement grips a second item of material and holds said second item of material at said printing table; and in a second position of the assembly, the first said arrangement holds said first item of material at said printing table, and the second said arrangement positions the second item of material at said delivery table, said means to impart a common reciprocating motion including a drive mechanism drivingly connected to a drive arm means for providing said reciprocating motion; said material gripping and displacement arrangements being integral with said beam member; said beam member being drivingly connected to said drive arm means, a guide member; said arrangements and said beam member being reciprocatingly displaceable along said guide member, said guide member provided with a free end and a fixed end so as to pivotal movement upwards and downwards of the free end about the fixed end so that each item of material is moved sequentially downward from the insertion table to the printing table and then to the delivery table.

3. Stencil printing machine comprising: a fixed printing table for positioning material at a printing position; a fixed insertion table for positioning fresh items of material at an insertion position remote from said printing table and at a height different from said printing table; first and second reciprocably movable material gripping and displacement arrangements; and a stencil frame for tensioning a stencil above a printing table; a beam, said material gripping and displacement arrangements being joined to said beam to form an assembly of arrangements; fixed means for guiding said beam member along a path, said first gripping arrangement being pivotably secured to said beam so that said first gripping arrangement is movable between a lowered position approximately coplanar with said printing position and a raised position approximately coplanar with said insertion position, said second gripping arrangement being fixed approximately coplanar with said printing position; drive arm means for imparting a common reciprocating motion to the arrangements such that in operation in a first position of the assembly, said first gripping arrangement grips a fresh item of material from said insertion position and said second gripping arrangement grips a second, printed item of material from said printing position so to carry said first and second items of material to a second position of the assembly where said first gripping arrangement delivers and releases the fresh item of material to be printed to the printing position and the second said arrangement delivers and releases the second item of material to a delivery position, said drive arm means returning said assembly to said first position after said first gripping arrangement returns to said raised position.

4. Stencil printing machine according to claim 3, characterized in that said first gripping arrangement has a smooth and planar upper surface, which lies substantially in the same plane as the item of material resting at the printing position when said first gripping arrangement is at said lowered position.

5. Stencil printing machine according to claim 3, characterized, in that said stencil frame can be raised or lowered, the print being transferable onto a said item of material resting upon the printing table when the frame is in its lower position.

6. Stencil printing machine according to claim 4, characterized in, that said stencil frame can be raised or lowered, the print being transferable onto a said item of material resting upon the printing table when the frame is in its lower position.

* * * * *